United States Patent [19]

Dutcher et al.

[11] Patent Number: 4,931,155

[45] Date of Patent: Jun. 5, 1990

[54] ELECTROLYTIC REDUCTIVE COUPLING OF QUATERNARY AMMONIUM COMPOUNDS

[75] Inventors: John S. Dutcher; Hossein Sharifian; Alan R. Tanner, all of Austin, Tex.

[73] Assignee: Southwestern Analytical Chemicals, Inc., Austin, Tex.

[21] Appl. No.: 354,623

[22] Filed: May 19, 1989

[51] Int. Cl.[5] ..... C25B 3/00

[52] U.S. Cl. ..... 204/72; 204/73 R; 204/73 A

[58] Field of Search ..... 204/72, 73 R, 73 A, 204/74

[56] References Cited

U.S. PATENT DOCUMENTS

| | | | |
|---|---|---|---|
| 2,439,308 | 4/1948 | Lookley | 260/465.8 |
| 3,193,475 | 7/1965 | Baizer | 204/73 |
| 3,193,477 | 7/1965 | Baizer | 204/73 |
| 3,489,663 | 1/1970 | Bayer | 204/59 R |
| 3,627,651 | 12/1971 | Colchester et al. | 204/73 |
| 3,630,861 | 12/1971 | Thiais et al. | 204/73 A |
| 3,661,739 | 5/1972 | Tomilov et al. | 204/73 A |
| 3,717,646 | 2/1973 | Calchester et al. | 260/295 AM |
| 3,876,514 | 4/1975 | Baizer | 204/59 R |
| 3,899,401 | 8/1975 | Nohe et al. | 204/59 R |
| 4,087,336 | 5/1978 | Wagenkneckt | 204/76 |
| 4,176,020 | 11/1979 | Misumi et al. | 204/72 |
| 4,253,921 | 3/1981 | Baldwin et al. | 204/72 |
| 4,670,111 | 6/1987 | Tooney | 204/73 A |

*Primary Examiner*—John F. Niebling
*Assistant Examiner*—Steven P. Marquis
*Attorney, Agent, or Firm*—Renner, Otto, Boisselle & Sklar

[57] ABSTRACT

A process is described for the electrolytic reductive coupling of quaternary ammonium compounds to themselves or to other reactive organic compounds.

The process comprises (A) providing an electrolytic cell comprising an anode and a cathode;

(B) charging into the electrolytic cell, a solution containing at least one of said quaternary ammonium compounds, and, optionally, at least one other organic compound capable of reacting with the quaternary ammonium compound under the conditions of the reaction;

(C) passing an electric current through the electrolytic cell to reductively couple the quaternary ammonium compound to itself or to the other organic compound; and (D) recovering the solution containing the coupled product from the electrolytic cell. The process is particularly useful for the preparation of diquaternary ammonium compounds.

32 Claims, 1 Drawing Sheet

ELECTROLYTIC REDUCTIVE COUPLING OF QUATERNARY AMMONIUM COMPOUNDS

TECHNICAL FIELD

This invention relates to the electrolytic reductive coupling of quaternary ammonium compounds, and more particularly, to the electrolytic reductive coupling of quaternary ammonium compounds to themselves or to other reactive organic compounds.

BACKGROUND OF THE INVENTION

Various electrolytic hydrodimerization processes for ethylenically unsaturated compounds in aqueous solutions have been proposed in the prior art. For example, alpha, beta-ethylenically unsaturated ketones, and unsaturated compounds such as coumarin, stilbene and acrolein have been hydrodimerized by electrolysis in aqueous medium. Various publications and patents have described the hydrodimerization of these and other compounds. For example, U.S. Pat. No.3,630,861 describes the hydrodimerization of acrylonitrile to adiponitrile. A homogeneous aqueous solution of the acrylonitrile and a quaternary ammonium salt of an oxygen-containing inorganic acid at a pH of from 5 to 10 is subjected to electrolysis in a single compartment cell to form adiponitrile with reduced formation of by-products. The electrolytic reductive coupling of hydroxy benzaldehydes is described in U.S. Pat. No. 4,087,336. The production of pinnacols by electrolytic hydrodimerization of carbonyl compounds is described in U.S. Pat. No. 3,899,401.

The electrolytic hydrodimerization of pyridinium salts is described in the prior art. For example, U.S. Pat. No. 3,627,651 describes a process for the production of 1,1'-disubstituted-4,4'-bipyridylium salt which comprises reducing electrolytically an N-substituted pyridinium salt having in the 4-position a substituent which is a good leaving group and which is capable of forming a stable anion. Examples of good leaving groups are the cyanide group or a halide group. Other patents describing the electrolytic dimerization of various N-substituted pyridinium salts are U.S. Pat. Nos. 3,717,646; 4,176,020; and 4,670,111.

U.S. Pat. No. 3,661,739 describes a method of electrochemical hydrodimerization of olefinic compounds represented by the general formula $$CH_2{=}CHX$$

wherein X is selected from the group consisting of nitrile, ester, amide, aldehyde and carbonyl The electrolytic cell contains an anode and a cathode wherein the cathode is graphite having formed in the pores thereof, an ion-exchange polymer which is insoluble in the reaction mixture and contains tetraalkyl ammonium or a substituted tetraalkyl ammonium group.

SUMMARY OF THE INVENTION

A process is described for the electrolytic reductive coupling of quaternary ammonium compounds to themselves or to other reactive organic compounds, said quaternary compounds being characterized by the formula $$[(R^1)_3N^+{-}R^2]_aY^{-a} \qquad (I)$$

wherein each $R^1$ is independently an alkyl group containing from 1 to about 10 carbon atoms, a hydroxyalkyl or alkoxyalkyl group containing from 2 to about 10 carbon atoms, an aryl group, or two of the $R^1$ groups together with the nitrogen atom form a heterocyclic group, provided that if the heterocyclic group contains a C=N group, the third $R^1$ group is the second bond; $R^2$ is a hydrocarbyl group containing olefinic unsaturation, or a hydrocarbyl group containing a substituent which is electrolytically reactive or removable under the conditions of the process; $Y^-$ is an anion; and a is equal to the valence of Y; which process comprises (A) providing an electrolytic cell comprising an anode and a cathode;

(B) charging into the electrolytic cell, a solution containing at least one of said quaternary ammonium compounds (I), and, optionally, at least one other organic compound capable of reacting with the quaternary ammonium compound (I) under the conditions of the reaction;

(C) passing an electric current through the electrolytic cell to reductively couple the quaternary ammonium compound to itself or to the other organic compound; and (D) recovering the solution containing the coupled product from the electrolytic cell. The process is particularly useful for the preparation of diquaternary ammonium compounds.

DESCRIPTION OF THE PREFERRED EMBODIMENTS

Figure 1:
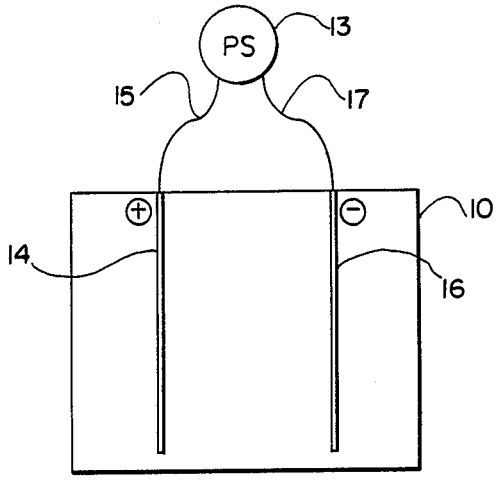
FIG. 1 is a schematic cross-section of an electrolytic cell useful in performing the electrolytic reductive coupling process of the invention.

The quaternary ammonium compounds which can be coupled to themselves or with other reactive organic compounds by the electrolytic process of the present invention are characterized by the formula $$[(R^1)_3N^+{-}R^2]_aY^{-a} \qquad (I)$$

wherein each $R^1$ is independently an alkyl group containing from 1 to about 10 carbon atoms, a hydroxyalkyl or alkoxyalkyl group containing from 2 to about 10 carbon atoms, an aryl group, or two of the $R^1$ groups together with the nitrogen atom form a heterocyclic group, provided that if the heterocyclic group contains a —C=N- group, the third $R^1$ group is the second bond; $R^2$ is a hydrocarbyl group containing olefinic unsaturation, or a hydrocarbyl group containing a substituent which is electrolytically reactive or removable under the conditions of the process; $Y^-$ is an anion; and a is equal to the valence of Y.

In a preferred embodiment, the $R^1$ groups are each independently alkyl groups containing from 1 to about 10 carbon atoms, and more generally from about 1 to about 4 carbon atoms. Specific examples of alkyl groups include methyl, ethyl, n-propyl, n-butyl, n-pentyl, n-hexyl, n-heptyl, n-octyl, n-nonyl and n-decyl groups. Preferred examples of alkyl groups include methyl, ethyl and butyl groups. The $R^1$ groups also may be hydroxyalkyl groups such as hydroxyethyl and the various isomers of hydroxypropyl, hydroxybutyl, hydroxypentyl, etc. Specific examples of alkoxy alkyl groups include methoxymethyl, ethyoxymethyl, ethoxyethyl, butoxyethyl, butoxybutyl, etc. The aryl groups may be substituted aryl groups as well as unsubstituted aryl groups, and the substituents may be any substituent which does not interfere with the coupling process. Examples of various aryl and hydroxyaryl groups useful as the $R^1$ groups include phenyl, benzyl, and equivalent groups wherein benzene rings have been substituted with one or more hydroxy groups.

Any two of the $R^1$ groups may comprise alkylene groups joined together with the nitrogen atom to form a heterocyclic group. The heterocyclic group may be saturated or unsaturated, and the heterocyclic group may contain 2 or more carbon atoms. If the heterocyclic group includes a —C=N- group, the third $R^1$ in Formula I constitutes the second bond. Examples of such heterocyclic groups include aziridine (2 carbon atoms) azetidine (3 carbon atoms), pyrrolidine (4 carbon atoms), substituted pyrrolidines, piperidine (5 carbon atoms), and substituted piperidines, pyridine (5 carbon atoms) and substituted pyridines.

$R^2$ in Formula I may be a hydrocarbyl group containing olefinic unsaturation, or $R^2$ may be a hydrocarbyl group containing a substituent which is electrolytically reactive or removable under the conditions of the reaction. The hydrocarbyl group $R^2$ containing an olefinic unsaturation may be represented by the following formula $$-[C(R^3)(R^4)]_bC(R^7)=C(R^5)(R^6) \quad \text{(IA)}$$

wherein $R^3$, $R^4$, $R^5$, $R^6$ and $R^7$ are each independently hydrogen or lower alkyl groups; and b is O or an integer of from 1 to about 8. Lower alkyl groups generally contain from about 1 to about 6 or 7 carbon atoms and examples include methyl, ethyl, propyl, isopropyl, butyl, pentyl, hexyl, etc. In one preferred embodiment, $R^5$ and $R^6$ are hydrogen atoms, and, therefore, the olefinic group is a terminal olefinic group. In another embodiment, $R^3$, $R^4$ and $R^7$ are hydrogen, and b is 1. Specific examples of such $R^2$ groups include vinyl, allyl, 1-butenyl, 2-butenyl, 2-methyl-1-propenyl, etc.

$R^2$ in Formula I also may be a hydrocarbyl group containing a substituent which is electrolytically reactive or removable under the conditions of the reaction. Thus, in one embodiment, $R^2$ may be characterized by the formula

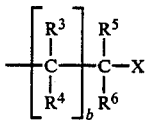

(IB)

wherein $R^3$, $R^4$, $R^5$ and $R^6$ are each independently hydrogen or lower alkyl groups; X is a halide, nitrile or nitro group, and b is 0 or an integer from 1 to about 8.

In another embodiment, $R^3$ and $R^4$ are hydrogen, and b is an integer from about 1 to about 5. In a further embodiment, $R^5$ and $R^6$ are also hydrogen. The hydrocarbyl group may contain any number of carbon atoms and generally will contain from 1 to about 10 carbon atoms. More particularly, the hydrocarbyl group will contain from 1 to about 5 carbon atoms. Examples of electrolytically removable groups include the cyano, nitro and halo groups. Specific examples of $R^2$ groups containing such removable groups include: $CH_2Cl$, $CH_2CN$, $CH_2CH_2Cl$, $CH_2CH_2Br$, $CH_2CH_2CN$, $CH_2CH_2NO_2$, $CH_2CH_2CH_2Cl$, $CH_2CH_2CH_2Br$, $CH_2CH_2CH_2CN$, $CH_2CH_2CH_2NO_2$, $CH(CH_3)—CH_2CH_2Cl$, $CH_2CH(Cl)CH_3$, $CH_2CH(CN)CH_3$, etc.

The quaternary ammonium compounds (I) utilized in the present invention contain an anion ($Y^-$). The nature of the anion is not critical as long as the anion does not interfere with the desired electrolytic reduction and coupling reactions of the invention. Suitable anions include: hydroxide, halides such as chloride, bromide, fluoride and iodide, sulfates and hydrogen sulfates, phosphates including hydrogen phosphates, borates, carbonates, nitrates, tetrafluoroborates, hexafluorophosphates, and tetraphenylborates. Generally the anion $Y^-$ is an anion of an oxidized mineral acid. When the electrolytic reaction is conducted in an undivided cell (e.g., FIG. 1), it is preferred that the anion is chosen from those anions which are not oxidized at the anode or reduced at the cathode under the conditions of the reaction, and those which do not give harmful products when oxidized. The value of a in Formula I is equal to the valence of Y. For example, when Y is hydroxide or a halide, a is equal to 1; when Y is the sulfate anion, a is equal to 2; etc.

Specific examples of quaternary ammonium compounds represented by Formula I which are useful in the process of the present invention include: allyl trimethyl ammonium chloride, allyl triethyl ammonium chloride, allyl triethyl ammonium bromide, allyl triethyl ammonium hydroxide, allyl triethyl ammonium sulfate, allyl triethyl ammonium carbonate, allyl triethyl ammonium phosphate, allyl tripropyl ammonium chloride, allyl tributyl ammonium carbonate, allyl tributyl ammonium chloride, 3-chloro-1-propyl-tributyl ammonium chloride, 2-cloro-1-propyl-tributyl ammonium chloride, 2-chloro-1-ethyl-trimethyl ammonium chloride, 3-cyano-1-propyl-trimethyl ammonium chloride, 3-nitro1-propyl-tributyl ammonium chloride, allyl trihydroxyethyl ammonium chloride, N-allyl, N-ethylpyrolidinium chloride, N-allyl-pyridinium chloride, etc.

The solution charged to the electrolytic cell may be an aqueous solution or organic solution containing a proton source such as $H_2SO_4$, $NH_4Cl$, etc. Alcohol solvents such as methanol can be used. Aqueous solutions generally are preferable.

When the aqueous solution charged to the electrolytic cell contains only one quaternary ammonium compound characterized by Formula I, the product obtained by the process of the invention is a symmetrical diquaternary ammonium compound, and the number of carbon atoms between the two nitrogen atoms will be two times the number of carbon atoms contained in the $R^2$ groups of quaternary ammonium compound charged to the electrolytic cell. The reductive coupling of a quaternary ammonium compound is represented by the following equation utilizing allyl trimethyl ammonium chloride as the quaternary ammonium compound.

$$[(CH_3)_3N^+—CH_2CH=CH_2]Cl^- + 2H^+ + 2e^- = [(CH_3)_3N^+CH_2CH_2CH_2]_2.2Cl^- \quad (1)$$

When two or more quaternary ammonium compounds are contained in the solution charged to the electrolytic cell, one of the products obtained is an unsymmetrical diquaternary ammonium compound, and symmetrical quaternary ammonium compounds also may be formed from each of the quaternary ammonium compounds charged to the cell. The formation of unsymmetrical diquaternary ammonium compounds is illustrated in the following two equations.

$$[(CH_3)_3N^+CH_2CH{=}CH_2]Cl^- + [(Bu)_3N^+CH_2CH{=}CH_2]Cl^- + 2H^+ + 2e^- = (CH_3)_3N^+{-}(CH_2)_6{-}N^+(Bu)_3\ 2Cl^- \quad (2)$$

$$[(CH_3)_3N^+CH_2CH{=}CH_2]Cl^- + [(Bu)_3N^+CH_2CH_2Br]Cl^- + H^+ + 1e^- = (CH_3)_3N^+{-}(CH_2)_5N^+(Bu)_3\ 2Cl^- \quad (3)$$

In addition to the quaternary ammonium compounds described above, the aqueous solutions charged to the electrolytic cell also may contain other reactive organic compounds which can be coupled with the electrolytically reduced quaternary ammonium compounds. The reactive organic compounds which can be included in the solutions charged to the electrolytic cell may be compounds which are activated under the electrolysis conditions, or the reactive compounds may react with the activated quaternary compounds even when the reactive compound is not activated under the electrolysis conditions. These reactive compounds include substituted hydrocarbons which contain a substituent which is reactive or removable under the conditions of the process, or an alpha,beta-olefinic halide, nitrile, carboxylate, carboxamide, aldehydo or keto compound. Any substituted hydrocarbon which contains a substituent which is reactive or removable under the conditions of the process can be utilized in the process of the present invention and coupled with the quaternary ammonium compounds described above. Examples of substituents which are reactive include halide, carboxylate, carboxamide, aldehydo or keto groups. Examples of substituents which are electrolytically removable under the conditions of the reaction include the halide, nitro or nitrile groups.

Examples of substituted hydrocarbons containing removable substituents include: ethyl chloride, ethyl bromide, 1-chloropropane, 2-chloropropane, 1-bromopropane, 2-bromopropane, 1-chlorobutane, nitroethane, 1-nitropropane, 2-nitropropane, 1-nitrobutane, 1-nitropentane, acetonitrile, proprionitrile, butyronitrile, etc.

The coupling reaction between a quaternary ammonium compound and the above-described substituted hydrocarbons is illustrated by the following equations.

$$[(CH_3)_3N^+CH_2CH{=}CH_2]Cl^- + CH_3CH_2CH_2Cl + 1H^+ + 1e^- = [(CH_3)_3N^+(CH_2)_5CH_3]Cl \quad (4)$$

$$[(CH_3)_3N^+CH_2CH{=}CH_2]Cl^- + CH_3CH_2CH_2CHO + 2H^+ + 1e^- = [(CH_3)_3N^+(CH_2)_3CH(OH)CH_2CH_2CH_3]Cl^- \quad (5)$$

The alpha,beta-olefinic organic compounds which can be included in the quaternary ammonium compound-containing solutions charged to the electrolytic cell can be characterized by the following formula $$R^7(R^8)C{=}C(R^9)Z \quad (II)$$

wherein $R^7$, $R^8$ and $R^9$ are independently hydrogen or hydrocarbyl groups including alkyl and aryl groups. In particular, the hydrocarbyl groups are alkyl groups containing from 1 to about 7 carbon atoms and more generally 1 or 2 carbon atoms; and Z is a cyano, carboxylate, carboxamide, aldehydo or keto group. Specific examples of alpha,beta-olefinically unsaturated compounds of the type represented by Formula II include: acrylonitrile, methacrylonitrile, butylmethacrylate, crotonitrile, ethylcrotonate, 2-pentenenitrile, N,N-diethylcrotonamide, 3,4-dimethyladiponitrile, ethylacrylate, butylacrylte, acrolein, crotonaldehyde, 2-ethylcrotonaldehyde, 2-ethyl-2-hexenaldehyde, 3-methyl-3-buten-2-one.

Electrolytic coupling of quaternary ammonium compounds with alpha,beta-olefinic compounds of the type represented by Formula II in which the quaternary ammonium compound is reduced to form an activated reactant which then reacts with the alpha,beta-unsaturated compound which is an acceptor is illustrated in the following equation.

$$[(CH_3)_3N^+CH_2CH{=}CH_2]Cl + CH_2{=}CH{-}C(O)OC_2H_5 + 2H^+ + 2e^- = [(CH_3)_3N^+(CH_2)_5C(O)OC_2H_5]Cl^- \quad (6)$$

The solutions of the quaternary ammonium compounds charged to the electrolytic cell generally comprise from about 3% to about 55% by weight of the quaternary ammonium compound and more often will contain from about 5% to about 40% by weight of the quaternary ammonium compound. When the solution contains a mixture of a quaternary organic compound and another reactive organic compound, the solution charged to the cell will comprise from about 3% to about 55% by weight of the mixture, or in one preferred embodiment, from about 5% to about 40% by weight of the mixture.

In one embodiment of the invention the process for the electrolytic reductive coupling of the above-described quaternary ammonium compounds to themselves or to other reactive organic compounds comprises the steps of (A) providing an electrolytic cell comprising an anode and a cathode;

(B) charging into the electrolytic cell, a solution containing at least one of said quaternary ammonium compounds (I), and, optionally, at least one other organic compound capable of reacting with the quaternary ammonium compound (I) under the conditions of the reaction;

(C) passing an electric current through the electrolytic cell to reductively couple the quaternary ammonium compound to itself or to the other organic compound; and (D) recovering the solution containing the coupled product from the electrolytic cell.

FIG. 1 is a schematic cross-section or representation of an electrolytic cell which can be utilized to carry out the above process of the present invention. In this figure, electrolytic cell 10 comprises an anode 14 and a cathode 16. The anode 14 is attached to power supply 13 by wire 15, and the cathode 16 is attached to power supply 13 through wire 17.

Various materials which have been used as anodes in electrolytic cells can be included in the cells used in the above and other embodiments of the present invention provided they do not react with the solution added to the cells. For example, the anode may be made of high purity graphite or metals such as, for example, titanium-coated or clad electrodes, tantalum, zirconium, hafnium or alloys of the same. Generally, the anodes will have a non-passivable and catalytic film which may comprise metallic noble metals such as platinum, iridium, rhodium or alloys thereof, or a mixture of electroconductive oxides comprising at least one oxide or mixed oxides of a noble metal such as platinum, iridium, ruthenium, palladium or rhodium.

Various materials which have been used as cathodes in electrolytic cells can be included in the cells used in the above and other embodiments of the present invention. Cathode materials include nickel, carbon, iron, stainless steel, nickel plated titanium, etc. Preferably, the cathodes in electrolytic cells utilized in the process of the present invention comprise zinc, cadmium, tin, lead, copper, iron or titanium or alloys thereof, mercury or mercury amalgams. The term "alloy" is used in a broad sense and includes intimate mixtures of two or more metals as well as one metal coated onto another metal. The mercury amalgam cathodes include, for example, mercury on nickel, mercury on copper, mercury on cadmium, mercury on zinc, etc. The above-described anode and cathode materials may be coated or dispersed on a metal or inert substrate to form the desired anode or cathode.

During the electrolysis, it is desirable that the temperature of the liquid within the cell be maintained within the range of from about 10° to about 70° C., and more generally, the temperature is maintained at about 50° C. or below during electrolysis.

Electrolysis of the aqueous solution containing the quaternary ammonium compound contained in the electrolytic cell is effected by impressing a current voltage (generally direct current) between the anode and the cathode with a current density of about 5 to about 250 $A/ft^2$, and more preferably at a current density of from about 25 to about 150 $A/ft^2$. Alternatively, the current density may be about 1-100 $A/dm^2$ or 10-50 $A/dm^2$. The current density is applied to the cell for a period of time which is sufficient to result in the desired reductive coupling reaction. In practice, such electrolytic cell can be operated batchwise or in a continuous operation.

In another embodiment, the process of the present invention is carried out in an electrolytic cell which comprises an anolyte compartment containing an anode and a catholyte compartment containing a cathode, the two compartments being separated by a gas separating divider. More specifically, the process of this embodiment comprises the steps of (A) charging an anolyte comprising an aqueous solution of an acid to the anolyte compartment; (B) charging a catholyte solution to the catholyte compartment, said solution comprising an aqueous solution of at least one quaternary ammonium compound, and, optionally, at least one other electrolytically reactive organic compound, said quaternary ammonium compound being characterized by the formula $$[(R^1)_3N^+—R^2]_aY^{-a} \quad (I)$$

wherein each $R^1$ is independently an alkyl group containing from 1 to about 10 carbon atoms, a hydroxyalkyl or alkoxyalkyl group containing from 2 to about 10 carbon atoms, an aryl group, or two of the $R^1$ groups together with the nitrogen atom form a heterocyclic group, provided that if the heterocyclic group contains a —C=N— group, the third $R^1$ group is the second bond; $R^2$ is a hydrocarbyl group containing olefinic unsaturation, or a hydrocarbyl group containing a substituent which is electrolytically reactive or removable under the conditions of the reaction; $Y^-$ is an anion; and a is equal to the valence of Y; (C) passing a current through the electrolysis cell whereby the quaternary ammonium compound is coupled to itself or, when present, to the other organic compound; and (D) recovering the solution containing the coupled product from the catholyte compartment.

The divider in the above-described electrolytic cell may be any material which functions as a gas separator. Examples of such divider materials include inert fabrics, sintered glass, ceramics, and membrane diaphragms. Membrane diaphragms are particularly useful and are preferred. The membrane dividers are preferably cation-exchange membranes.

Figure 2:
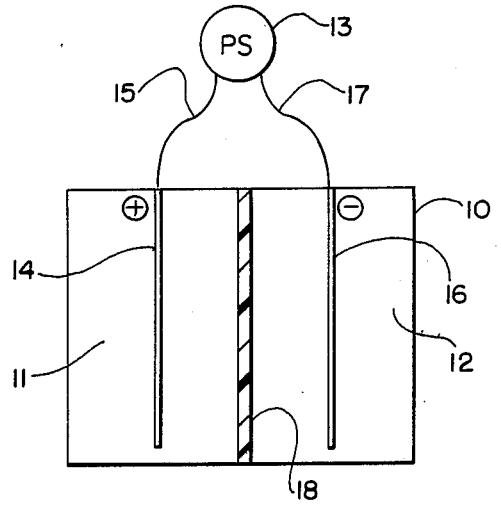
FIG. 2 is a schematic cross-section of a preferred and divided electrolytic cell useful in performing the electrolytic reductive coupling process of the invention.

A schematic cross-sectional representation of an electrolytic cell for carrying out the process of this embodiment and utilizing a divider such as a membrane diaphragm is shown in FIG. 2. In this figure, the electrolytic cell 10 comprises an anolyte compartment 11 and a catholyte compartment 12 separated from each other by membrane 18. The anolyte compartment 11 contains anode 14 which is attached to power supply 13 by wire 15. The catholyte compartment 12 contains cathode 16 which is attached to power supply 13 through wire 11.

The materials identified previously as being useful as anodes and cathodes can be utilized as the anodes and cathodes in this embodiment, and, as in the previous embodiment, the cathodes preferably comprise zinc, cadmium, tin, lead, copper, iron or titanium or alloys thereof, mercury or mercury amalgam. The process of the present invention utilizing an electrolytic cell of the type described above and shown in FIG. 2 is illustrated by the following representative example. An aqueous solution containing a quaternary ammonium compound (I) is charged to the catholyte compartment 12, and an electrolyte is charged to the anolyte compartment 11. An electrical potential is established and maintained by power source 13 between anode 14 and cathode 16 to produce a flow of current across the cell 10 to reduce the quaternary ammonium compound or the other organic compound present and couple the reduced species to itself or the other compound present in the solution. The solution containing the coupled product may be removed from the catholyte compartment and, if desired, the coupled product can be isolated.

The electrolyte charged to the anolyte compartment is aqueous solution of an acid. The acids generally are inorganic acids such as sulfuric acid, nitric acid, hydrochloric acid, and phosphoric acid. Mixtures of such acids may be used. The concentration of acid in the solution may be 0.1 to 5 molar.

As noted previously, the electrolysis cell utilized in the process of the present invention may contain ion-exchange membranes as dividers. The ionexchange membranes generally are cation-exchange membranes. These membranes belong to the well-known classes of organic commercial polymers containing polar groups of cationic character in the form of thin films. The membranes are capable of transferring cations, i.e., they are permeable to certain kinds of ions but substantially less permeable or even impermeable to others. The preparation and structure of cationic membranes are described in the chapter entitled "Membrane Technology"in *Encyclopedia of Chemical Technology*, Kirk-Othmer, Third Edition, Volume 15, pp. 92–131. Wiley & Sons, New York, 1985. These pages are hereby incorporated by reference for their disclosure of various cationic membranes which can be useful in the process of the present invention.

The cation-exchange membrane may be any of those which have been used in the electrolysis of quaternary ammonium salts to quaternary ammonium hydroxides. Preferably, the cation-exchange membranes should comprise a highly durable material such as the membranes based on the fluorocarbon series, or from less expensive materials of the polystyrene or polypropylene series. Preferably, however, the cationic membranes useful in the present invention include fluorinated membranes containing cation exchange groups such as perfluorosulfonic acid and perfluorosulfonic acid/perfluorocarboxylic acid perfluorocarbon polymer membranes such as sold by the E.I. duPont de Nemours & Company under the trade designation "NAFION". Other suitable cation-exchange membranes include styrene-divinylbenzene copolymer membranes containing cation-exchange groups such as sulfonate groups, carboxylate groups, etc.

Electrolysis of the solutions containing the quaternary ammonium compounds (I) in the electrolytic cells containing dividers such as ion-exchange membranes is effected by impressing a current voltage (generally direct current voltage) between the anode and cathode with a current density of from about 5 to about 250 $A/ft^2$, and more preferably the current density of from about 25 to about 150 $A/ft^2$. Alternatively, the current density may be from about 1 to about 100 $A/dm^2$ or 10–50 $A/dm^2$. The current is applied to the cell for a period which is sufficient to result in the desired electrolytic reductive coupling in the solutions contained in the catholyte compartment. In practice, the electrolytic cell can be operated batchwise or in a continuous operation.

The following examples illustrate the process of the present invention utilizing a divided cell of the type illustrated in FIG. 2. Unless otherwise indicated in the following examples and elsewhere in the specification and claims, all parts and percentages are by weight, temperatures are in degrees Celsius, and pressure is at or near atmospheric pressure.

EXAMPLE 1

A small electrolytic cell is prepared which comprises a catholyte compartment containing a lead cathode (40 $cm^2$) and an anolyte compartment containing a platinum clad anode (40 $cm^2$) separated by a Nafion 427 membrane (DuPont). The anolyte compartment is charged with 100 ml. of 1.0 M sulfuric acid, and the catholyte compartment is charged with 100 ml. of 0.1 M allyl tributyl ammonium chloride in deionized water. Electrolysis is carried out at an applied current of 1.0 amperes at a temperature of about 60° C. for a period of 24 hours. A portion or all of the catholyte solution is removed from the cell and the solution contains the desired product. The product, which can be recovered from the solution by crystallization is hexamethylene bis(tributylammonium chloride). Analysis of the solid product indicates an overall current efficiency of 80% for the electrohydrodimerization reaction.

EXAMPLE 2

The apparatus used in this example is the same as that used in Example 1 with the exception that an amalgomated copper electrode is used as the cathode. The anolyte is 100 ml. of 1.0 M sulfuric acid solution, and the catholyte solution is 100 ml. of 0.1 M allyl tributylammonium chloride in deionized water. The electrolysis is conducted at an applied current of 1.0 A at a temperature of 25° C. The electrolysis product is recovered by evaporation of the catholyte solution under vacuum at 60° C. for a period of 24 hours. Analysis of the solid product indicates an overall current efficiency of 80% for the electrohydrodimerization of allyl tributylammonium chloride to hexamethylene bis(tributylammonium chloride).

EXAMPLE 3

The apparatus utilized in Example 1 is used in this example with the exception that a cadmium electrode is used as the cathode. The anolyte is 100 ml. of 1.0 M sulfuric acid solution, and the catholyte is 100 ml. of 0.1 M allyl tributylammonium chloride in deionized water. The electrolysis product is evaporated under vaccum at 60° C. over a period of 24 hours, and analysis of the product indicates an overall current efficiency of 75% for the electrodimerization reaction.

EXAMPLE 4

The procedure and apparatus used in this example is the same as used in Example 1 with the exception that a zinc electrode is used as the cathode. Analysis of the solids product indicates an overall current efficiency of 60% for the electrohydrodimerization of allyl tributylammonium chloride to hexamethylene bis(tributylammonium chloride).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for the electrolytic reductive coupling of quaternary ammonium compounds to themselves or to other reactive organic compounds, said quaternary compounds being characterized by the formula $$[(R^1)_3N^+—R^2]_aY^{-a} \quad (I)$$

wherein each $R^1$ is independently an alkyl group containing from 1 to about 10 carbon atoms, a hydroxyalkyl or alkoxyalkyl group containing from 2 to about 10 carbon atoms, an aryl group, or two of the $R^1$ groups together with the nitrogen atom form a heterocyclic group, provided that if the heterocyclic group contains a —C=N— group, the third $R^1$ group is the second bond; $R^2$ is a hydrocarbyl group containing olefinic unsaturation, or a hydrocarbyl group containing a substituent which is electrolytically reactive or removable under the conditions of the process; $Y^-$ is an anion; and a is equal to the valence of Y; which process comprises (A) providing an electrolytic cell comprising an anode and a cathode;

(B) charging into the electrolytic cell, an aqueous solution containing a proton source, at least one of said quaternary ammonium compounds (I), and, optionally, at least one other organic compound capable of reacting with the quaternary ammonium compound (I) under the conditions of the reaction;

(C) passing an electric current through the electrolytic cell to reductively couple the quaternary ammonium compound to itself or to the other organic compound; and (D) recovering the solution containing the coupled product from the electrolytic cell.

2. The process of claim 1 wherein the quaternary ammonium compound (I) is the only electrolytically reducible or reactive compound in the aqueous solution charged to the cell in step (B).

3. The process of claim 1 wherein each $R^1$ group is independently an alkyl group containing from 1 to about 4 carbon atoms.

4. The process of claim 1 wherein $R^2$ is a hydrocarbon group containing from 2 to about 5 carbon atoms and an olefin group.

5. The process of claim 4 wherein $R^2$ contains a terminal olefinic group.

6. The process of claim 1 wherein $R^2$ is a substituted hydrocarbyl group containing from 1 to about 10 carbon atoms, and Y is a substituent selected from the group consisting of a halide, nitro or nitrile group.

7. The process of claim 1 wherein the solution charged to the cell in step (B) comprises at least two different quaternary compounds characterized by Formula I.

8. The process of claim 1 wherein the other organic compound contained in the solution charged in step (B) is another quaternary ammonium compound characterized by Formula I, a substituted hydrocarbon which contains a substituent which is reactive or removable under the conditions of the process, or an alpha,beta olefinic nitrile, carboxylate, carboxamide, aldehydo or keto compound.

9. A process for the electrolytic reductive coupling of a quaternary ammonium compound to itself or to other reactive organic compounds in an electrolysis cell which comprises an anolyte compartment containing an anode, and a catholyte compartment containing a cathode, the anolyte and catholyte compartments being separated from each other by a gas separation divider, said process comprising (A) charging an anolyte comprising an aqueous solution of an acid to the anolyte compartment;

(B) charging a catholyte solution to the catholyte compartment, said solution comprising an aqueous solution of a proton source, at least one quaternary ammonium compound, and, optionally, at least one other electrolytically reactive organic compound, said quaternary ammonium compound being characterized by the formula $$[(R^1)_3N^+—R^2]_aY^{-a} \quad (I)$$

wherein each $R^1$ is independently an alkyl group containing from 1 to about 10 carbon atoms, a hydroxyalkyl or alkoxyalkyl group containing from 2 to about 10 carbon atoms, an aryl group, or two of the $R^1$ groups together with the nitrogen atom form a heterocyclic group, provided that if the heterocyclic group contains a —C=N— group, the third $R^1$ group is the second bond; $R^2$ is a hydrocarbyl group containing olefinic unsaturation, or a hydrocarbyl group containing a substituent which is electrolytically reactive or removable under the conditions of the reaction; $Y^-$ is an anion; and a is equal to the valence of Y;

(C) passing a current through the electrolysis cell whereby the quaternary ammonium compound is coupled to itself or, when present, to the other organic compound; and (D) recovering the solution containing the coupled product from the catholyte compartment.

10. The process of claim 9 wherein the quaternary ammonium compound characterized by Formula I is the only electrolytically active compound in the solution charged to the catholyte compartment.

11. The process of claim 10 wherein the solution contains at least two different quaternary ammonium compounds characterized by Formula I.

12. The process of claim 9 wherein each $R^1$ group in Formula I is independently an alkyl group containing from 1 to about 4 carbon atoms.

13. The process of claim 9 wherein $R^2$ in Formula I is a hydrocarbon group containing from 2 to about 5 carbon atoms and an olefin group.

14. The process of claim 13 wherein the olefin group is a terminal olefin group.

15. The process of claim 9 wherein $R^2$ in Formula I is a hydrocarbyl group containing from 1 to about 10 carbon atoms, and Y is a substituent selected from the group consisting of a halide, nitro or nitrile group.

16. The process of claim 9 wherein the gas separating divider is a cation exchange membrane.

17. The process of claim 16 wherein the cation exchange membrane comprises a perfluorosulfonic acid or a perfluorosulfonic/perfluorocarboxylic acid perfluorocarbon polymer membrane.

18. A process for preparing diquaternary ammonium compounds in an electrolysis cell which comprises an anolyte compartment containing an anode and a catholyte compartment containing a cathode, the anolyte and catholyte compartments being separated from each other by cation exchange membrane, said process comprising (A) charging an anolyte comprising an aqueous solution of an acid to the anolyte compartment;

(B) charging a catholyte comprising an aqueous solution of at least one quaternary ammonium compound to the catholyte compartment, said quaternary ammonium compound being characterized by the formula $$[(R^1)_3N^+—R^2]_aY^{-a} \quad (I)$$

wherein each $R^1$ is independently an alkyl group containing from 1 to about 10 carbon atoms, a hydroxyalkyl or alkoxyalkyl group containing from 2 to about 10 carbon atoms, an aryl group, or two of the $R^1$ groups together with the nitrogen atom form a heterocyclic group, provided that if the heterocyclic group contains a —C=N— group, the third $R^1$ group is the second bond; $R^2$ is a hydrocarbyl group containing olefinic unsaturation or a hydrocarbyl group containing a substituent which is reactive or removable under the conditions of the reaction; $Y^-$ is an anion; and a is equal to the valence of Y;

(C) passing a current through the electrolysis cell whereby the quaternary ammonium compound containing the olefin is reductively coupled, or the removable substituent is removed from the hydrocarbon group followed by coupling of the residue to form the desired diquaternary ammonium compound in the catholyte compartment; and (D) recovering the solution containing the desired diquaternary ammonium compound from the catholyte compartment.

19. The process of claim 18 wherein the acid in the solution charged in step (A) is an inorganic acid selected from the group consisting of sulfuric, hydrochloric, nitric and phosphoric acids or mixtures thereof.

20. The process of claim 18 wherein $R^2$ in the quaternary ammonium compound (I) is an olefinic group characterized by the formula $$-[C(R^3)(R^4)]_bC(R^7)=C(R^5)(R^6) \quad \text{(IA)}$$

wherein $R^3$, $R^4$, $R^5$, $R^6$ and $R^7$ are each independently hydrogen or lower alkyl groups; and b is O or an integer from 1 to about 8.

21. The process of claim 20 wherein $R^5$ and $R^6$ are hydrogen

22. The process of claim 20 wherein b is 1 and $R^3$, $R^4$, $R^5$, $R^6$ and $R^7$ are hydrogen.

23. The process of claim 20 wherein b is O.

24. The process of claim 20 wherein b is 1.

25. The process of claim 18 wherein $R^2$ in the quaternary ammonium compound (I) is characterized by the formula

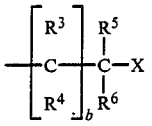

(IB)

wherein $R^3$, $R^4$, $R^5$ and $R^6$ are each independently hydrogen or lower alkyl groups; X is a halide, nitrile or nitro group, and b is 0 or an integer from 1 to about 8.

26. The process of claim 25 wherein X is a halide.

27. The process of claim 25 wherein $R^3$ and $R^4$ are hydrogen and b is an integer of from about 1 to about 5.

28. The process of claim 25 wherein $R^5$ and $R^6$ are hydrogen.

29. The process of claim 18 wherein the acid charged to the anolyte compartment in (A) is sulfuric acid.

30. The process of claim 18 wherein the cation exchange membrane comprises a perfluorosulfonic acid or a perfluorosulfonic/perfluorocarboxylic acid perfluorocarbon polymer membrane.

31. The process of claim 18 wherein the current passed through the electrolysis cell is direct current.

32. The process of claim 18 wherein the cathode comprises zinc, cadmium, tin, lead, copper, iron or titanium, alloys and mixtures thereof, mercury or mercury amalgam.

* * * * *